US010386778B2

(12) United States Patent
Saito

(10) Patent No.: US 10,386,778 B2
(45) Date of Patent: Aug. 20, 2019

(54) IMAGE FORMING APPARATUS

(71) Applicant: KYOCERA Document Solutions Inc., Osaka-shi, Osaka (JP)

(72) Inventor: Yosuke Saito, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/200,422

(22) Filed: Nov. 26, 2018

(65) Prior Publication Data

US 2019/0163116 A1 May 30, 2019

(30) Foreign Application Priority Data

Nov. 28, 2017 (JP) ..... 2017-227514

(51) Int. Cl.
*G03G 21/08* (2006.01)
*G03G 15/01* (2006.01)
*G03G 21/00* (2006.01)

(52) U.S. Cl.
CPC ..... *G03G 21/08* (2013.01); *G03G 15/0131* (2013.01); *G03G 21/0005* (2013.01); *G03G 2215/0132* (2013.01)

(58) Field of Classification Search
CPC .... G03G 21/08; G03G 21/0094; G03G 21/06; G03G 15/0275
USPC ..... 399/51, 55, 118, 128
See application file for complete search history.

(56) References Cited

U.S. PATENT DOCUMENTS 9,933,723 B2 * 4/2018 Saito ..... G03G 21/08
2013/0136499 A1 5/2013 Kamiyama
2014/0093264 A1 * 4/2014 Matsushita ..... G03G 15/065 399/55

FOREIGN PATENT DOCUMENTS

JP 2013113901 A 6/2013

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

In an image forming apparatus, a neutralizing portion provided on an image forming unit is configured to emit a neutralizing light toward a front irradiation position between a developing portion and a first transfer portion 15, on a photoconductor drum of an image forming unit, and a rear irradiation position between the first transfer portion and a cleaning portion, on the photoconductor drum of the image forming unit. A light quantity limiting portion is configured to limit an amount of light irradiated on the front irradiation position of the image forming unit, such that the amount of light is less than amounts of light irradiated on other front irradiation positions.

5 Claims, 8 Drawing Sheets

IMAGE FORMING APPARATUS

INCORPORATION BY REFERENCE

This application is based upon and claims the benefit of priority from the corresponding Japanese Patent Application No. 2017-227514 filed on Nov. 28, 2017, the entire contents of which are incorporated herein by reference.

BACKGROUND

The present disclosure relates to an electrophotographic image forming apparatus including a neutralizing portion configured to irradiate a light on an image carrier to neutralize the image carrier.

In the electrophotographic image forming apparatus, modulated light is irradiated on a plurality of photoconductor drums that are charged by a charging process, based on image data. With this configuration, electrostatic latent images are formed on the surfaces of the photoconductor drums. Next, the electrostatic latent images are developed by colors of toner different from one another, and toner images corresponding to the colors are formed on the surfaces. Here, the colors may be a plurality of chromatic colors, and black. In a case where an intermediate transfer method is adopted, by a first transfer process, the toner images are transferred from the photoconductor drums to an intermediate transfer belt running in a predetermined running direction to be superposed thereon.

In the image forming apparatus, there is a concern of transfer memory images, described below, forming on the surfaces. During the first transfer process, a transfer current flows through the photoconductor drums. An amount of the transfer current in areas on the surfaces on which toner is adhered is different from an amount of the transfer current in areas to which toner is not adhered. If an uneven charge generates on the surface due to this difference in the amounts of the transfer current, the transfer memory image forms on the surface.

It is known that in the image forming apparatus, a neutralizing device may be adopted for performing pre-transfer neutralization and post-transfer neutralization to prevent the transfer current from flowing to each of the photoconductor drums at a low cost. During the pre-transfer neutralization, the neutralizing device irradiates light on one of the photoconductor drums before the first transfer process. With this configuration, positive charge is removed from the surface, and generation of the uneven charge is prevented.

During the post-transfer neutralization, the neutralizing device irradiates light on another photoconductor drum that is adjacent to, in the running direction, the photoconductor drum on which light was irradiated during the pre-transfer neutralization. With this configuration, the positive charge is removed from the other photoconductor drum before the charging process.

SUMMARY

An image forming apparatus according to an aspect of the present disclosure includes three image forming units. The three image forming units each include a drum-like image carrier, and a developing portion, a transfer portion, and a cleaning portion sequentially disposed in a rotational direction of the drum-like image carrier. In addition, the three image forming units are a first image forming unit, a second image forming unit, and a third image forming unit. The first image forming unit is for forming a black toner image on an intermediate transfer member, and is provided on a downstream side of a running direction of the intermediate transfer member. The second image forming unit is for forming a chromatic color image on the intermediate transfer member, and is provided further upstream than the first image forming unit in the running direction. The third image forming unit is provided in such a way that the second image forming unit is positioned between the first image forming unit and the third image forming unit. The first image forming unit includes a first image carrier, a first developing portion, and a first transfer portion. The second image forming unit includes a second image carrier, a second developing portion, and a second transfer portion. The third image forming unit includes a third image carrier, a third developing portion, and a third transfer portion. In addition, the image forming apparatus includes a first neutralizing portion, a second neutralizing portion, and a light quantity limiting portion. The first neutralizing portion emits a neutralizing light toward a first irradiation position on the first image carrier between the first developing portion and the first transfer portion, and a second irradiation position on the second image carrier between the second transfer portion and the second cleaning portion. The second neutralizing portion emits a neutralizing light toward a third irradiation position on the second image carrier between the second developing portion and the second transfer portion, and a fourth irradiation position on the third image carrier between the third transfer portion and the third cleaning portion. The light quantity limiting portion limits an amount of light irradiated on the first irradiation position, such that the amount of light is less than an amount of light irradiated on the third irradiation position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Figure 1:
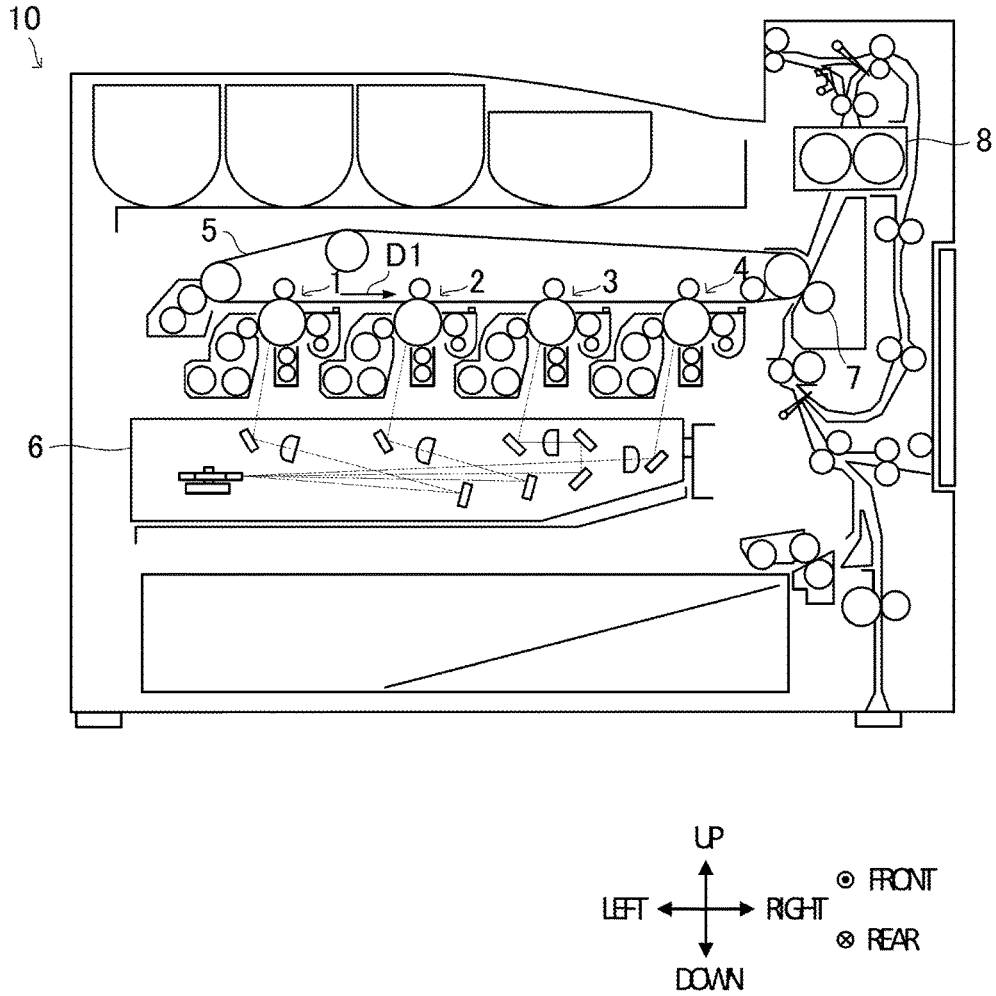
FIG. 1 is a schematic diagram showing a configuration of an image processing apparatus according to embodiments of the present disclosure.

In FIG. 1, The image forming apparatus 10 according to a first embodiment is a color printer configured to electrophotographically form a color or monochrome image on a sheet, based on image data input from an information processing device such as a personal computer. In addition, the image forming apparatus 10 may also be a facsimile, a copier, or a multifunctional peripheral. As shown in FIG. 1, the image forming apparatus 10 includes four image forming units 1 to 4, an intermediate transfer belt 5 as an intermediate transfer member, a laser scanning unit 6, a secondary transfer roller 7, and a fixing device 8.

The image forming units 1 to 4 constitute a so-called tandem image forming portion. Here, a lower part of the intermediate transfer belt 5 moves in a running direction D1 that is parallel to a left-right direction of the image forming apparatus 10. The image forming units 1 to 4 are juxtaposed along the running direction D1 below the lower part of the intermediate transfer belt 5. The image forming units 1, 2, 3, and 4 are provided for the colors yellow, cyan, magenta, and black to form yellow, cyan, magenta, and black toner images on the intermediate transfer belt 5, respectively. Yellow, magenta, and cyan are examples of chromatic colors in the present disclosure. The image forming units 1 to 4 are disposed in the order of the image forming unit 1, 2, 3, 4 from an upstream side to a downstream side of the running direction D1. The image forming units 4, 3, and 2 are examples of three image forming units in the present disclosure. Specifically, the image forming units 4, 3, and 2 are examples of a first image forming unit, a second image forming unit, and a third image forming unit in the present disclosure, respectively.

The image forming units 1 and 2 (see FIG. 2), and the image forming units 3 and 4 (see FIG. 3), each include a photoconductor drum 11, and a charging portion 12, a developing portion 13, a neutralizing portion 14, a first transfer portion 15, and a cleaning portion 16 that are provided in correspondence to the photoconductor drum 11. The image forming units 1 to 4 have the similar structure and configuration except for a light quantity limiting portion 17 described later, so the configurations of the image forming units 1 to 4 are described below comprehensively.

The photoconductor drum 11 is a drum-like image carrier, and four photoconductor drums 11 are juxtaposed along the running direction D1 below the intermediate transfer belt 5. In addition, the photoconductor drum 11 has a predetermined length in a front-rear direction of the image forming apparatus 10, and its upper end comes in contact with the bottom part of the intermediate transfer belt 5. In addition, the photoconductor drum 11 rotates in a direction D2 (hereafter referred to as a rotational direction D2) shown by an arrow D2. The charging portion 12, the developing portion 13, the neutralizing portion 14, the first transfer portion 15, and the cleaning portion 16 are sequentially disposed in the rotational direction D2 around the photoconductor drum 11. The photoconductor drums 11 for black, cyan, and magenta are examples of a first image carrier, a second image carrier, and a third image carrier in the present disclosure, respectively.

The charging portion 12 is provided facing a bottom end of the photoconductor drum 11. The charging portion 12 includes a charging roller 121. When a charging bias voltage is applied on the charging portion 12 by a power supply (not shown), the charging portion 12 charges the photoconductor drum 11 facing therewith. An electrostatic latent image is formed on the photoconductor drum 11 by light irradiated thereon by the laser scanning unit 6 (see FIG. 1). The light is modulated based on the image data.

The developing portion 13 faces the photoconductor drum 11 on a downstream side of the charging portion 12 in the rotational direction D2 of the photoconductor drum 11. In addition, four developing portions 13 are juxtaposed along the running direction D1 below the intermediate transfer belt 5. The developing portion 13 includes a developing roller 131 and a housing 132. The developing roller 131 is stored inside the housing 132. The housing 132 includes an upper surface S1 that is a flat surface parallel to the running direction D1, on an upper end thereof in the up-down direction. The upper surface S1 is separated from the lower part of the intermediate transfer belt 5 by a first separation distance G1. The first separation distance G1 is the same for the four developing portions 13. The developing portion 13 supplies toner (developer) to the photoconductor drum 11 to form a toner image thereon. Specifically, the developing portion 13 for black supplies black toner to the electrostatic latent image formed on the photoconductor drum 11. The developing portions 13 for yellow, magenta, and cyan respectively supply, as the chromatic colors, yellow, magenta, and cyan toner (that is, chromatic color toner) to the electrostatic latent images formed on the photoconductor drums 11. With this configuration, black and chromatic color toner images are formed.

The developing portions 13 for black, cyan, and magenta are examples of a first developing portion, a second developing portion, and a third developing portion in the present disclosure, respectively.

Four first transfer portions 15 are juxtaposed along the running direction D1. The first transfer portion 15 is provided on a downstream side of the developing portion 13 in the rotational direction D2. In addition, the first transfer portion 15 is provided facing the upper end of the photoconductor drum 11 across the intermediate transfer belt 5. In a first transfer process, the first transfer portion 15 transfers the toner image formed on the photoconductor drum 11 to the intermediate transfer belt 5 when a transfer bias voltage is applied on the first transfer portion 15 from a power supply (not shown).

More specifically, the first transfer portions 15 for black and the chromatic colors respectively transfer the black toner image and the chromatic color toner images to the intermediate transfer belt 5. The intermediate transfer belt 5 extends along the upper ends of the photoconductor drums 11, and the toner images are sequentially superposed in a same area on the intermediate transfer belt 5. The superposed toner image is carried on the intermediate transfer belt 5 and conveyed to the secondary transfer roller 7 (see FIG. 1). In addition, the sheet is also conveyed to the secondary transfer roller 7. The secondary transfer roller 7 transfers the superposed toner image carried by the intermediate transfer belt 5 to the sheet. The toner image on the sheet is heated by the fixing device 8 (see FIG. 1) to be fused and fixed to the sheet.

The first transfer portions 15 for black, cyan, and magenta are examples of a first transfer portion, a second transfer portion, and a third transfer portion in the present disclosure, respectively.

Figure 2:
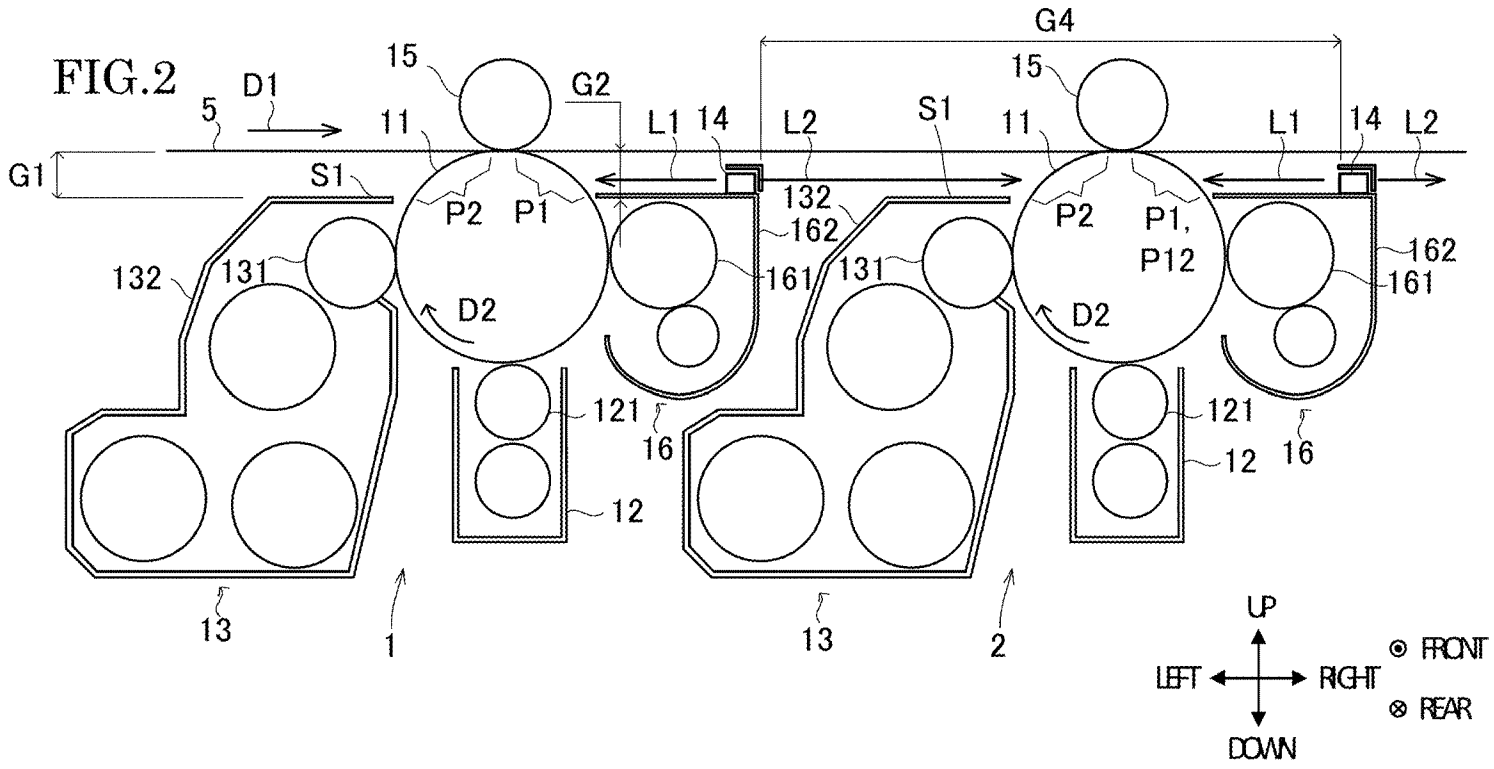
FIG. 2 is a schematic diagram showing image forming units for yellow and cyan according to a first embodiment of the present disclosure.
Figure 3:
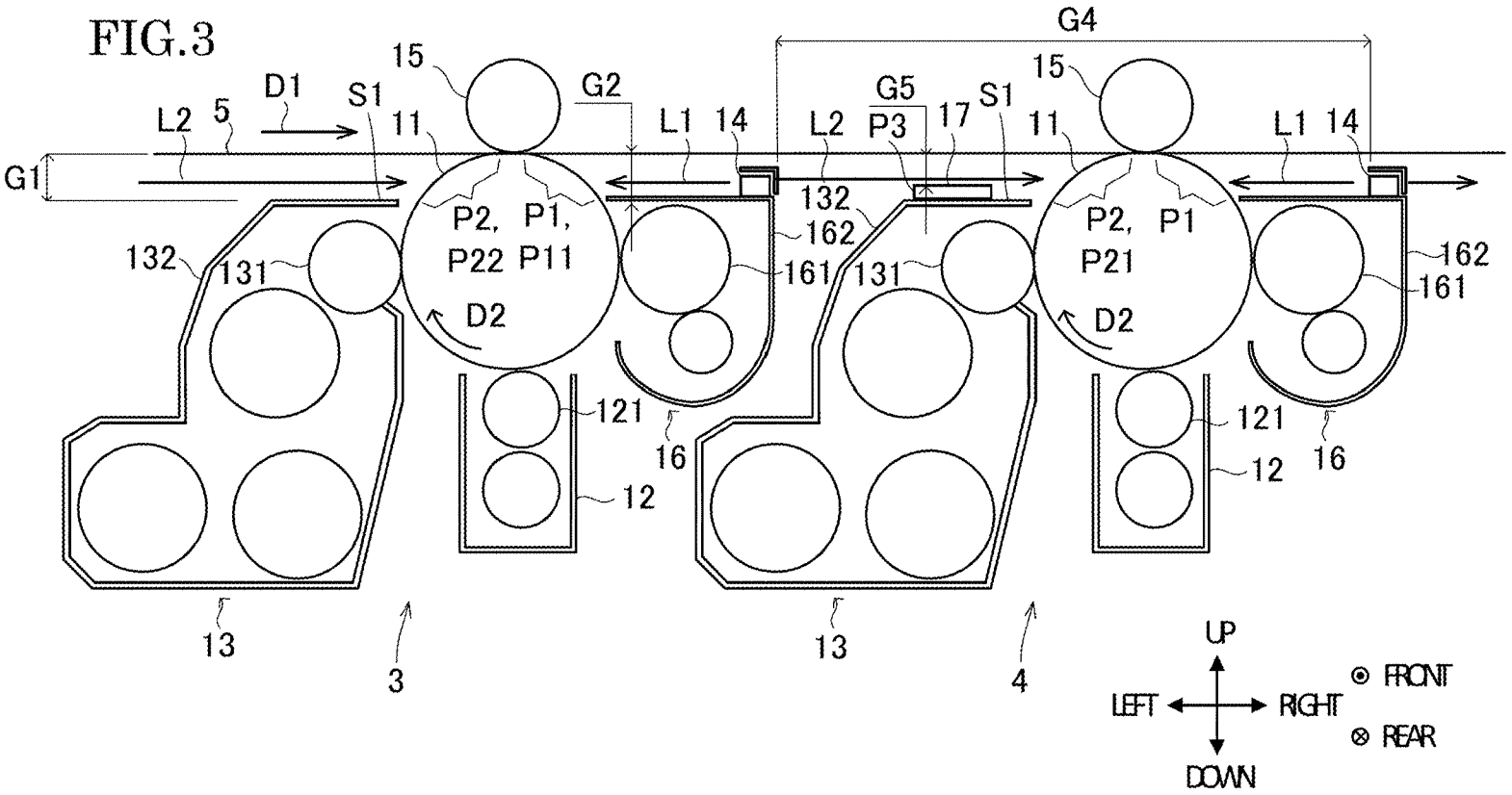
FIG. 3 is a schematic diagram showing image forming units for magenta and black according to the first embodiment of the present disclosure.

As shown in FIG. 2 and FIG. 3, the cleaning portion 16 is provided on a downstream side of the first transfer portion 15 in the rotational direction D2. In addition, four cleaning portions 16 are juxtaposed along the running direction D1. In addition, the cleaning portion 16 is disposed separated from the bottom part of the intermediate transfer belt 5 by a predetermined second separation distance G2. In addition, the cleaning portion 16 includes a cleaning member 161 such as a cleaning roller or a cleaning blade, and is configured to clean the photoconductor drum 11 after the toner image is transferred from the photoconductor drum 11 to the intermediate transfer belt 5.

The cleaning portions 16 for black, cyan, and magenta are examples of a first cleaning portion, a second cleaning portion, and a third cleaning portion in the present disclosure, respectively.

The neutralizing portion 14 is provided between the cleaning portion 16 and the intermediate transfer belt 5, separate from the bottom part of the intermediate transfer belt 5 by a predetermined distance. In addition, the neutralizing portion 14 is provided on an upper surface of a housing 162 of the cleaning portion 16 for its corresponding color. The neutralizing portion 14 provided on the image forming unit 3 and the neutralizing portion 14 provided on the image forming unit 2 are examples of a first neutralizing portion and a second neutralizing portion in the present disclosure, respectively.

In addition, the neutralizing portion 14 is configured to perform post-transfer and pre-transfer neutralization. The neutralizing portion 14 emits a neutralizing light L1 toward a rear irradiation position P1 for the post-transfer neutralization. The rear irradiation position P1 is a position between the first transfer portion 15 and the cleaning portion 16, on the photoconductor drum 11 that faces an upstream side of the neutralizing portion 14 in the running direction D1. In other words, the neutralizing portion 14 irradiates the neutralizing light L1 on a portion of the photoconductor drum 11 that is downstream from the first transfer portion 15 and upstream from the cleaning portion 16 in the rotational direction D2.

In addition, the neutralizing portion 14 emits a neutralizing light L2 toward a front irradiation position P2 for the pre-transfer neutralization. The front irradiation position P2 is a position between the developing portion 13 and the first transfer portion 15, on the photoconductor drum 11 that faces a downstream side of the neutralizing portion 14 in the running direction D1. In other words, the neutralizing portion 14 irradiates the neutralizing light L2 on a portion of the photoconductor drum 11 that is downstream from the developing portion 13 and upstream from the first transfer portion 15 in the rotational direction D2.

As described above, by neutralizing the photoconductor drum 11 before and after the first transfer process, it is possible to prevent a so-called memory image from being formed on the photoconductor drum 11. Specifically, by performing the pre-transfer neutralization before the first transfer process, a positive charge is removed from the photoconductor drum 11. This prevents the charge of the photoconductor drum 11 from becoming uneven, so it is possible to prevent the transfer memory image from being formed on the photoconductor drum 11.

In the present disclosure, the front irradiation position P2 of the image forming unit 4 and the front irradiation position P2 of the image forming unit 3 are examples of a first irradiation position and a third irradiation position, respectively. In addition, in the present disclosure, the rear irradiation position P1 of the image forming unit 3 and the rear irradiation position P1 of the image forming unit 2 are examples of a second irradiation position and a fourth irradiation position, respectively. For the sake of easy understanding, the first irradiation position and the third irradiation position of the image forming units 4 and 3 are respectively denoted by reference symbols P21 and P22 in FIG. 3. In addition, the second irradiation position of the image forming unit 3 is denoted by a reference symbol P11 in FIG. 3, and the fourth irradiation position of the image forming unit 2 is denoted by a reference symbol P12 in FIG. 2.

In addition, since yellow images are inconspicuous, the issue of memory image formation is not apparent for the photoconductor drum 11 for yellow, even if the neutralizing light L2 is not irradiated thereon. Accordingly, a neutralizing portion 14 for irradiating the neutralizing light L2 on the photoconductor drum 11 for yellow is not provided in the image forming apparatus 10. This reduces the total number of neutralizing portions 14, and allows for cost reduction of the image forming apparatus 10.

To prevent memory image formation, it is necessary to increase the amount of light irradiated on the photoconductor drum 11 during the pre-transfer neutralization, so more positive charge is removed from the photoconductor drum 11. On the other hand, if the positive charge is largely removed, it becomes easier for toner to move from a portion of the photoconductor drum 11 to which the toner is adhered, to a non-adhering portion. If the movement of the toner occurs in a thin linear part of the toner image (for example, a character or a figure), the linear part can become unsharp. Linear parts are often included in black toner images. Accordingly, with respect to the photoconductor drum 11 for black, it is necessary to prevent the movement of toner rather than the formation of the transfer memory image. On the other hand, for photographs or the like printed in chromatic colors, since gradation is more important than sharpness, it is necessary to prevent the formation of the transfer memory image.

In the first embodiment, the neutralizing portions 14 (see FIG. 2 and FIG. 3) have configurations as described below, and the image forming apparatus 10 includes the light quantity limiting portion 17 on the developing portion 13 for black (see FIG. 3).

In FIG. 2 and FIG. 3, the neutralizing portions 14 for the chromatic colors are disposed between the photoconductor drums 11 juxtaposed along the running direction D1, one neutralizing portion 14 for each space between the photoconductor drums 11, at the same positions with respect to the up-down direction and the front-rear direction. In addition, the neutralizing portions 14 for the chromatic colors are separated from one another by a predetermined fourth separation distance G4. The neutralizing portion 14 for black is disposed at the same position as the neutralizing portions 14 for the chromatic colors with respect to the up-down direction and the front-rear direction, and with respect to the left-right direction, the neutralizing portion 14 for black is disposed at a position separate from the neutralizing portion 14 for magenta by the fourth separation distance G4, on a downstream side thereof in the running direction D1. The neutralizing portions 14 for all of the colors have the same configuration except for their positions as described above. Thus, in the following, the neutralizing portions 14 are described comprehensively.

Figure 4:
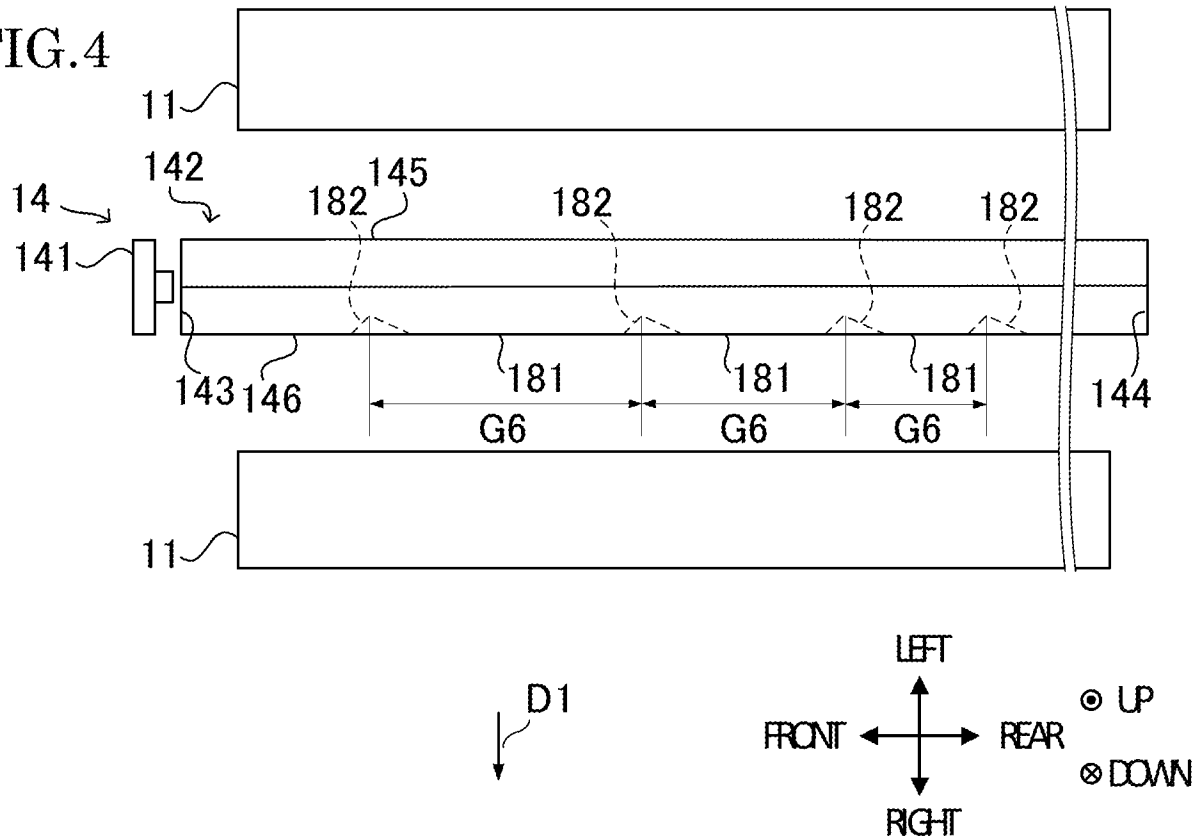
FIG. 4 is a schematic diagram showing a detailed configuration of a neutralizing portion shown in FIG. 1 and FIG. 2.

As shown in FIG. 4, the neutralizing portion 14 includes a light source 141 and a light guiding member 142. The light guiding member 142 has a predetermined length in the front-rear direction that is longer than the photoconductor drum 11. The light guiding member 142 is provided extending in the front-rear direction, and interposed between the photoconductor drums 11 on its upstream and downstream side in the running direction D1. The front-rear direction is an example of an orthogonal direction in the present disclosure.

In addition, the light source 141 and the light guiding member 142 provided on the image forming unit 3 are examples of a first light source and a first light guiding member in the present disclosure. In addition, the light source 141 and the light guiding member 142 provided on the image forming unit 2 are examples of a second light source and a second light guiding member in the present disclosure.

The light source 141 is an LED (Light Emitting Device) or the like configured to emit a light having a predetermined wavelength band, by inputting an electric current thereto from a power supply (not shown). The wavelength band is in a visible light region. The light source 141 is provided facing a light incident surface 143 that is an end surface on one end in the front-rear direction of the light guiding member 142, at a position separate from the light incident surface 143 by a predetermined distance. The light source 141 may be provided on the other end of the light guiding member 142. The light source 141 emits light toward the light incident surface 143. Here, amounts of light emitted by the light sources 141 for black and the chromatic colors are the same.

A part of light incident on the light guiding member 142 propagates in the light guiding member 142 toward an end surface 144 that is opposite of the light incident surface 143 in the front-rear direction, while totally reflecting at a boundary surface between the light guiding member 142 and an external space.

Figure 6:
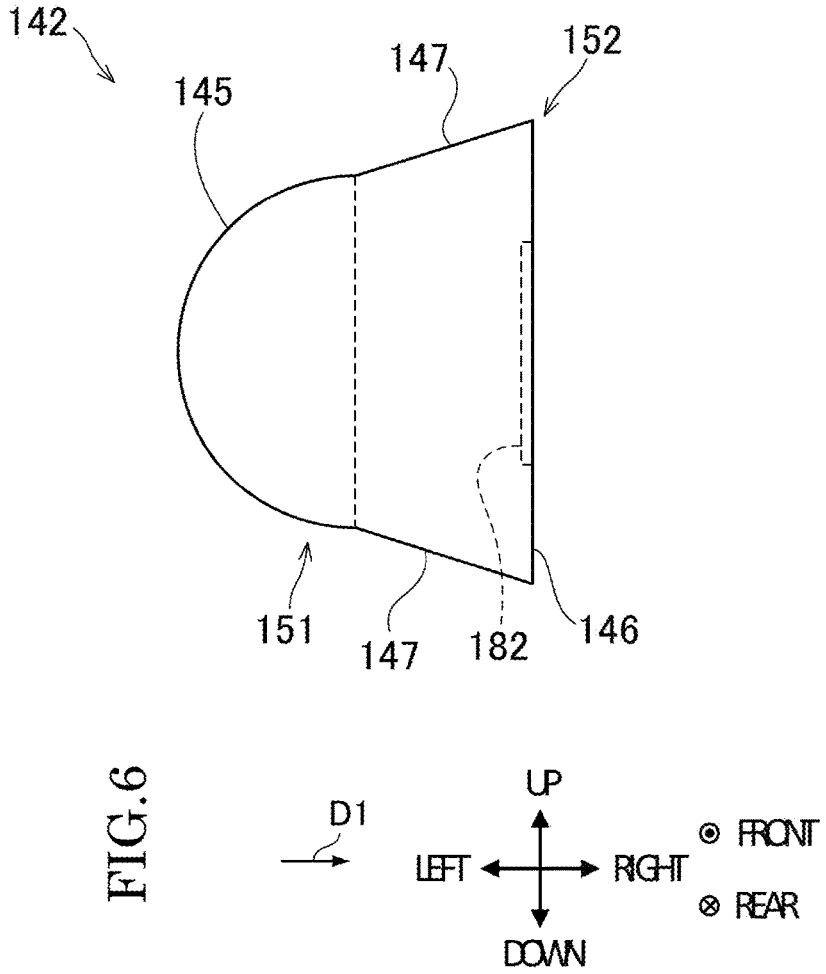
FIG. 6 is a schematic diagram showing a cross-section of the light guiding member shown in FIG. 4, in a direction orthogonal to a front-rear direction of the light guiding member.

The light guiding member 142 is made of transparent resin material, glass, or the like. As shown in FIG. 6, the light guiding member 142 includes a semicircular portion 151 and a trapezoidal portion 152 on its surface. Cross-sections of the semicircular portion 151 and the trapezoidal portion 152 oriented orthogonally with respect to the front-rear direction are substantially shaped in a semicircular shape and a trapezoidal shape, respectively. The light guiding member 142 has a shape of a diameter part of the semicircular portion 151 joined with an upper base part of the trapezoidal portion 152.

The light guiding member 142 includes, on its surface, a first optical surface 145, a second optical surface 146, and two third optical surfaces 147. The first optical surface 145 is a curved surface that is a part of the outer periphery of the semicircular portion 151 that faces the diameter part. The second optical surface 146 is a flat surface that is a lower base part of the trapezoidal portion 152. In addition, the two third optical surfaces 147 are flat surfaces that are each one of two legs of the trapezoidal portion 152. A distance between the two third optical surfaces 147 widens as they extend toward the second optical surface 146.

As shown in FIG. 4, the light guiding member 142 of the configuration described above is provided extending along the front-rear direction with one photoconductor drum 11 on its upstream side, and another photoconductor drum 11 on its downstream side in the running direction D1. Specifically, the light guiding member 142 is disposed such that the first optical surface 145 faces the photoconductor drum 11 on the upstream side of the light guiding member 142 in the running direction D1, and the second optical surface 146 faces the photoconductor drum 11 on the downstream side of the light guiding member 142 in the running direction D1.

Figure 5:
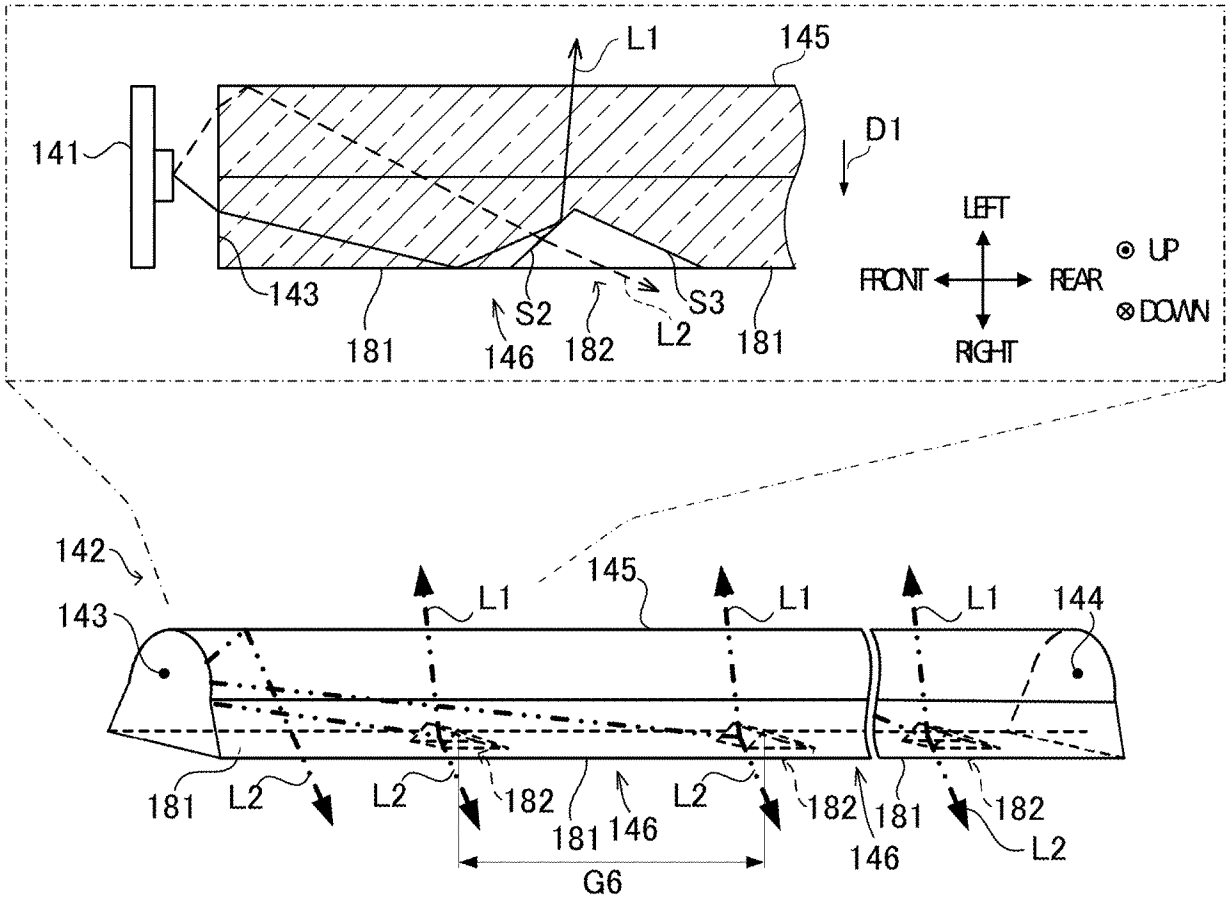
FIG. 5 is a schematic diagram showing light propagating in a light guiding portion shown in FIG. 4, and optical paths of rays of neutralizing light.

More specifically, as shown in FIG. 5, the second optical surface 146 includes a flat portion 181 and a plurality of refraction/reflection portions 182. The plurality of refraction/reflection portions 182 are juxtaposed on the second optical surface 146 of the light guiding member 142 along the front-rear direction, separated from one another by a predetermined interval G6. Each refraction/reflection portion 182 is a prism that is a groove whose cross-section along a plane orthogonal to the flat portion 181 is triangular. The refraction/reflection portion 182 may be a reflective sheet instead of the prism. The refraction/reflection portion 182 includes a front inclined surface S2 and a rear inclined surface S3 (see figure framed by a one-dot chain line in FIG. 5) respectively inclined with respect to the front-rear direction at a predetermined front incline angle and rear incline angle. The front inclined surface S2 and the rear inclined surface S3 are inclined from the flat portion 181 toward the inside of the light guiding member 142.

In FIG. 5, light propagating in the light guiding member 142 is made incident on the front inclined surfaces S2 and the rear inclined surfaces S3 of the refraction/reflection portions 182. Parts of the incident light reflect at the front inclined surfaces S2 and the rear inclined surfaces S3, and are emitted from the first optical surface 145 of the light guiding member 142 toward the rear irradiation positions P1 (see FIG. 3) as rays of the neutralizing light L1 that is linear light extending along the front-rear direction. In addition, the remaining parts of the incident light refract at the front inclined surfaces S2 and the rear inclined surfaces S3, and are emitted from the second optical surface 146 of the light guiding member 142 toward the front irradiation positions P2 (see FIG. 3) as rays of the neutralizing light L2 extending along the front-rear direction.

Here, the front incline angle, the rear incline angle, and the interval G6 of the light guiding member 142 are predetermined according to experiments or simulations performed during a designing stage of the image forming apparatus 10, such that the neutralizing light L1 and the neutralizing light L2 have even amounts of light in the front-rear direction. In addition, an amount of the neutralizing light L2 is predetermined according to the experiments or the simulations, such that the amount of the neutralizing light L2 is suitable for preventing formation of the transfer memory image, especially on the photoconductor drums 11 for the chromatic colors. With this configuration, it is possible to prevent gradation in photos or the like printed in the chromatic colors from deteriorating due to the transfer memory image.

In the present embodiment, the further the interval G6 between two refraction/reflection portions 182 adjacent in the front-rear direction is from the light source 141 (that is, the closer the interval G6 is to the end surface 144 of the light guiding member 142), the narrower the interval G6 is. This is because amount of light in the light guiding member 142 gradually decreases as the incident light propagates from the light incident surface 143 to the end surface 144 of the light guiding member 142. By adjusting the intervals G6 as needed, it is possible to make the amounts of the neutralizing light L1 and the neutralizing light L2 even in the front-rear direction of the light guiding member 142.

In FIG. 3, the light quantity limiting portion 17 limits the amount of the neutralizing light L2 irradiated on the front irradiation position P2 (that is, the first irradiation position P21) of the image forming unit 4, such that it is less than the amount of the neutralizing light L2 irradiated on the front irradiation position P2 (that is, the third irradiation position P22) of the image forming unit 3. Specifically, the light quantity limiting portion 17 is made of a light-impermeable resin or the like, and has a sheet-like shape. A length of the light quantity limiting portion 17 in the front-rear direction is longer than or equal to the photoconductor drum 11 for black. A width of the light quantity limiting portion 17 in the left-right direction is narrower than or equal to the upper surface S1 for black. The light quantity limiting portion 17 is provided on the housing 132 of the developing portion 13 for black at a position near the intermediate transfer belt 5. The position may be on the upper surface S1 of the developing portion 13 for black. The light quantity limiting portion 17 is interposed between the housing 132 and the intermediate transfer belt 5, and is separated in a downward direction from the bottom part of the intermediate transfer belt 5 by a fifth separation distance G5. A thickness of the light quantity limiting portion 17 in the up-down direction is G1 minus G5. The fifth separation distance G5 is predetermined as a value smaller than the first separation distance G1, so that the neutralizing light L2 can be irradiated on the first irradiation position P21. With this configuration, a gap between the light quantity limiting portion 17 and the intermediate transfer belt 5 is smaller than a gap between the intermediate transfer belt 5 and the housings 132 of the developing portions 13 of the image forming unit 3 and 2.

Specifically, since the thickness of the light quantity limiting portion 17 is G1 minus G5, a part of the neutralizing light L2 irradiated from the neutralizing portion 14 is blocked by the light quantity limiting portion 17, and less light is irradiated on the front irradiation position P2 (that is, the first irradiation position P21) of the image forming unit 4 than the front irradiation position P2 (that is, the third irradiation position P22) of the image forming unit 3. Here, G1 minus G5 that is the thickness of the light quantity limiting portion 17 is specified as a value according to the experiments or the simulations, such that movement of the black toner at the first irradiation position P21 can be prevented. This prevents the linear part of the black toner image such as a character from becoming unsharp. The black toner image may be a grayscale image. Accordingly, the thickness of the light quantity limiting portion 17 may be determined to a value that is smaller than the first separation distance G1 so that the light quantity limiting portion 17 is separated from the bottom part of the intermediate transfer belt 5, based on gradation of the grayscale image and sharpness of the linear portion.

In addition, a portion P3 on a surface of the light quantity limiting portion 17 facing the neutralizing portion 14 has light absorbing properties with respect to the wavelength band of the neutralizing light L2. Specifically, the portion P3 is preliminarily colored in a color having high light absorbing properties (for example, black). This allows the light quantity limiting portion 17 to absorb light incident on the portion P3 among the neutralizing light L2 irradiated from the neutralizing portion 14. That is, since light reflection at the portion P3 is prevented, it is possible to prevent occurrence of stray light inside the image forming apparatus 10.

In addition, the light quantity limiting portion 17 is provided on the housing 132 of the developing portion 13 for black. This allows for the housings 132 of the four colors to be same, thus reducing cost of manufacturing and managing a mold for making the housing 132. In addition, the developing portion 13 for black has the same shape and configuration as the developing portions 13 for the chromatic colors. In addition, the neutralizing portions 14 for the four colors have the same configuration and can be positioned in the same way with respect to their corresponding developing portions 13. This makes it possible for the electric currents input to the light sources 141 for the four colors to be the same. Accordingly, control of the electric currents input to the light sources 141 can be simplified.

The light quantity limiting portion 17 may be provided on an upper surface of the housing 162 of the cleaning portion 16, instead of on the developing portion 13. The light quantity limiting portion 17 may be a rib provided integrally with a housing of the developing portion 13 for black that projects toward the intermediate transfer belt 5 from the housing 132 or the housing 162 by a predetermined height, without coming in contact with the intermediate transfer belt 5.

Upper surfaces of housings of the developing portions 13 for the chromatic colors may be separated further from the intermediate transfer belt 5 than an upper surface of a housing of the developing portion 13 for black. In this case, an upper end of the developing portion 13 for black functions as the light quantity limiting portion 17.

The thickness of the light quantity limiting portion 17 is described above as being uniform from one end to the other in the front-rear direction. However, the amount of the neutralizing light L2 emitted from the neutralizing portion 14 may be different depending on its position in the front-rear direction. In this case, thickness of the light quantity limiting portion 17 may be made different in response to the difference in the amount of the neutralizing light L2.

Figure 7:
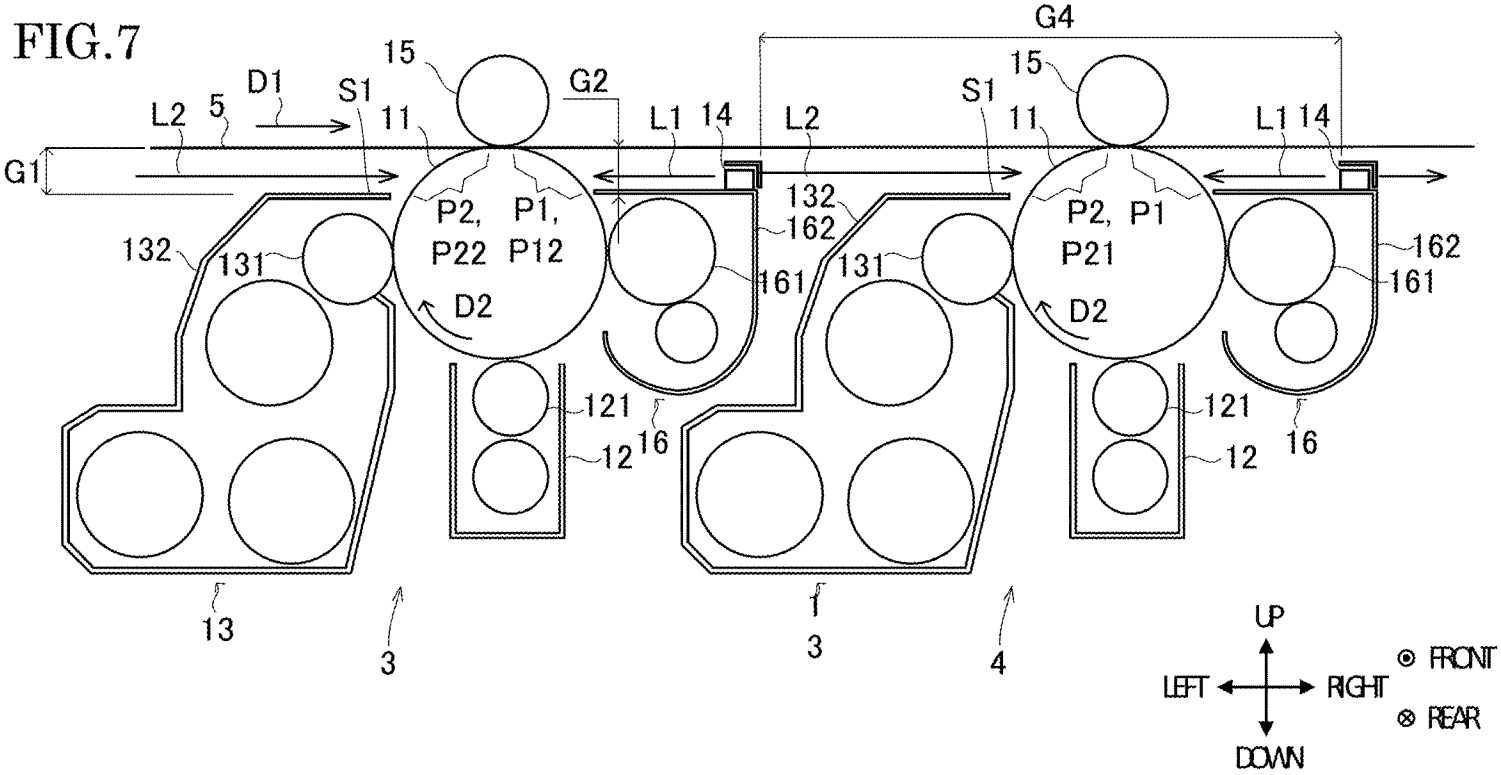
FIG. 7 is a schematic diagram showing image forming units for magenta and black according to a second embodiment of the present disclosure.

Hereinafter, with reference to FIG. 7 and FIG. 8, an image forming apparatus 10 according to a second embodiment is described. In FIG. 7, components that are the same as the components shown in FIG. 1 to FIG. 6 are denoted by the same reference symbols, and explanations of the same components are omitted.

In FIG. 7, the image forming apparatus 10 does not include the light quantity limiting portion 17 (see FIG. 3) on the image forming unit 4, and differs from the image forming apparatus 10 of the first embodiment in that the refraction/reflection portion 182 of the neutralizing portion 14 (see FIG. 3) provided on the image forming unit 3 is the light quantity limiting portion 17.

Figure 8:
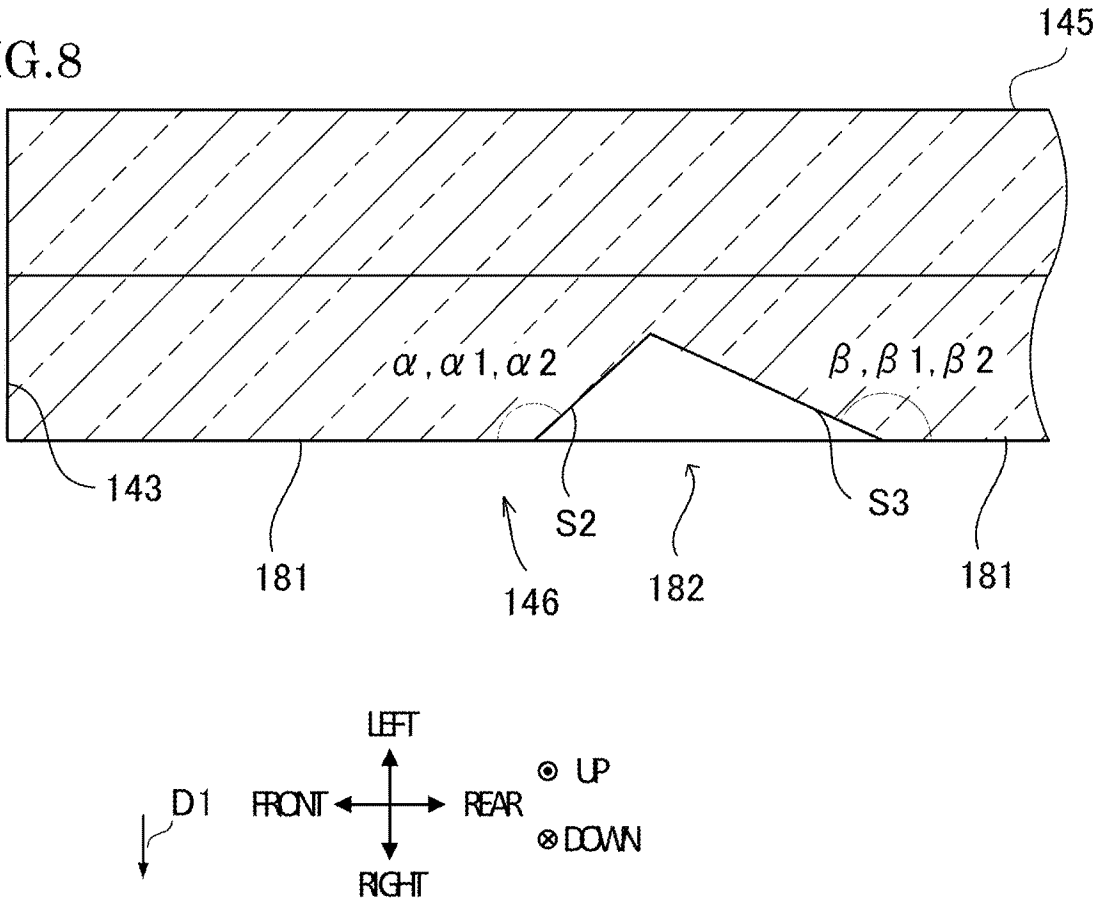
FIG. 8 is a schematic diagram showing incline angles of a refraction/reflection portion according to the second embodiment of the present disclosure.

Specifically, as shown in FIG. 8, the refraction/reflection portions 182 of the neutralizing portions 14 are grooves whose cross-sections along the plane orthogonal to the flat portion 181 are triangular, and the refraction/reflection portions 182 include the front inclined surface S2 and the rear inclined surface S3 inclined from the flat portion 181 toward the inside of the light guiding member 142 at a front incline angle $\alpha$ and a rear incline angle ß. Here, the front incline angle $\alpha$ and the rear incline angle ß are angles inclined toward the inside of the light guiding member 142 among angles formed by the front inclined surface S2 and the rear inclined surface S3 with the flat portion 181.

Here, in the image forming units 1 and 2 (see FIG. 2) and the image forming unit 4 (see FIG. 7), the front incline angle $\alpha$ and the rear incline angle ß are respectively referred to as $\alpha 1$ and ß1. In addition, in the image forming unit 3 (see FIG. 7), the front incline angle $\alpha$ and the rear incline angle ß are respectively referred to as $\alpha 2$ and ß2. $\alpha 1$, $\alpha 2$, ß1, and ß2 are predetermined as values that satisfy conditions $\alpha 2 > \alpha 1$ and ß2≥ß1. Even if $\alpha 2 > \alpha 1$ and ß2≥ß1, depth of the grooves in the image forming units 1 to 4 may be the same. With this configuration, reflectivity of the refraction/reflection portion 182 of the image forming unit 3 is larger than reflectivity of each of the refraction/reflection portions 182 of the image forming units 1, 2, and 4. Accordingly, the amount of the neutralizing light L2 emitted from the neutralizing portion 14 of the image forming unit 3 is smaller than the amount of the neutralizing light L2 emitted from each of the neutralizing portions 14 of the image forming units 1, 2, and 4. In other words, in the image forming unit 3, the refraction/reflection portion 182 functions as the light quantity limiting portion 17 for limited the amount of neutralizing light L2 emitted from the neutralizing portion 14.

Specifically, α1 and ß1 are predetermined according to the experiments or the simulations, such that the neutralizing light L2 prevents the transfer memory image from forming at the third irradiation position P22 or the like. In addition, α2 and ß2 are specified according to the experiments or the simulations, such that the neutralizing light L2 prevents the movement of the black toner at the first irradiation position P21.

The refraction/reflection portion 182 of the image forming unit 3 (that is, the refraction/reflection portion 182 for magenta) is an example of a first refraction/reflection portion in the present disclosure. In addition, the front incline angle α, the rear incline angle ß, the front inclined surface S2, and the rear inclined surface S3 of the refraction/reflection portion 182 for magenta are examples of a first incline angle, a second incline angle, a first inclined surface, and a second inclined surface in the present disclosure. In addition, the refraction/reflection portion 182 of the image forming unit 2 (that is, the refraction/reflection portion 182 for cyan) is an example of a second refraction/reflection portion in the present disclosure. In addition, the front incline angle α, the rear incline angle ß, the front inclined surface S2, and the rear inclined surface S3 of the refraction/reflection portion 182 for cyan are examples of a third incline angle, a fourth incline angle, a third inclined surface, and a fourth inclined surface in the present disclosure.

In addition, in the second embodiment, the first optical surface 145 faces the photoconductor drum 11 on its upstream side in the running direction D1, and the second optical surface 146 faces the photoconductor drum 11 on its downstream side in the running direction D1 (see FIG. 4). In this case, α1, α2, ß1, and ß2 are values that satisfy the conditions α2>α1 and ß2≥ß1. However, depending on how the first optical surface 145 and the second optical surface 146 are disposed, α1, α2, ß1, and ß2 may be values that satisfy conditions α2<α1 and ß2<ß1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

three image forming units juxtaposed along a running direction of an intermediate transfer member, each of the three image forming units including a drum-like image carrier, and a developing portion, a transfer portion, and a cleaning portion sequentially disposed in a rotational direction of the drum-like image carrier, wherein the three image forming units are a first image forming unit for forming a black toner image on the intermediate transfer member, provided downstream in the running direction, a second image forming unit for forming a chromatic color toner image on the intermediate transfer member, provided further upstream than the first image forming unit in the running direction, and a third image forming unit provided in such a way that the second image forming unit is positioned between the first image forming unit and the third image forming unit, wherein the first image forming unit includes a first image carrier, a first developing portion, and a first transfer portion, the second image forming unit includes a second image carrier, a second developing portion, a second transfer portion, and a second cleaning portion, and the third image forming unit includes a third image carrier, a third transfer portion, and a third cleaning portion;

a first neutralizing portion configured to emit a neutralizing light toward a first irradiation position on the first image carrier between the first developing portion and the first transfer portion, and a second irradiation position on the second image carrier between the second transfer portion and the second cleaning portion;

a second neutralizing portion configured to emit a neutralizing light toward a third irradiation position on the second image carrier between the second developing portion and the second transfer portion, and a fourth irradiation position on the third image carrier between the third transfer portion and the third cleaning portion; and a light quantity limiting portion configured to limit an amount of light irradiated on the first irradiation position, such that the amount of light is less than another amount of light irradiated on the third irradiation position.

2. The image forming apparatus according to claim 1, wherein the light quantity limiting portion is provided on a housing of the first image forming unit, interposed between the housing and the intermediate transfer member.

3. The image forming apparatus according to claim 2, wherein the light quantity limiting portion is separate from the intermediate transfer member, and a gap between the light quantity limiting portion and the intermediate transfer member is narrower than a gap between the intermediate transfer member and the housings of the second image forming unit and the third image forming unit.

4. The image forming apparatus according to claim 2, wherein the light quantity limiting portion has light absorbing properties.

5. The image forming apparatus according to claim 1, wherein the first neutralizing portion includes a first light guiding member provided between the first image carrier and the second image carrier, extending in an orthogonal direction that is orthogonal to the running direction, and a first light source configured to emit a light toward an end surface in the orthogonal direction of the first light guiding member, the light quantity limiting portion is a plurality of first refraction/reflection portions formed on a surface of the first light guiding member, configured to refract and reflect incident light at a first inclined surface and a second inclined surface that respectively incline at a first incline angle and a second incline angle toward an inner side of the first light guiding member with respect to the orthogonal direction, and emit neutralizing light from the first light guiding member toward the first irradiation position and the second irradiation position, and the second neutralizing portion includes a second light guiding member provided between the second image carrier and the third image carrier, extending in the orthogonal direction, a second light source configured to emit a light toward an end surface in the orthogonal direction of the second light guiding member, and a plurality of second refraction/reflection portions formed on a surface of the second light guiding member, configured to refract and reflect incident light at a third inclined surface and a fourth inclined surface that respectively incline at a third incline angle different from the first incline angle, and a fourth incline angle different from the second incline angle, toward an inner side of the second light guiding member with respect to the orthogonal direction, and emit neutralizing light from the second light guiding member toward the third irradiation position and the fourth irradiation position.

* * * * *